US008820238B2

(12) United States Patent
Brandenburg et al.

(10) Patent No.: US 8,820,238 B2
(45) Date of Patent: Sep. 2, 2014

(54) METHOD AND APPARATUS FOR CONTROLLING THE CUT REGISTER OF A WEB-FED ROTARY PRESS

(75) Inventors: Günther Brandenburg, Gröbenzell (DE); Stefan Geissenberger, Augsburg (DE)

(73) Assignee: manroland AG, Augsburg (DE)

( * ) Notice: Subject to any disclaimer, the term of this patent is extended or adjusted under 35 U.S.C. 154(b) by 456 days.

(21) Appl. No.: 10/529,271

(22) PCT Filed: Sep. 24, 2003

(86) PCT No.: PCT/EP03/10615

§ 371 (c)(1),
(2), (4) Date: Mar. 25, 2005

(87) PCT Pub. No.: WO2004/033167

PCT Pub. Date: Apr. 22, 2004

(65) Prior Publication Data

US 2005/0247220 A1 Nov. 10, 2005

(30) Foreign Application Priority Data

Oct. 2, 2002 (DE) ..... 102 45 962

(51) Int. Cl.

| | |
|---|---|
| ***B41F 1/34*** | (2006.01) |
| ***B65H 23/04*** | (2006.01) |
| ***B26D 5/20*** | (2006.01) |
| ***B65H 23/188*** | (2006.01) |
| ***B41F 13/60*** | (2006.01) |

(52) U.S. Cl.

CPC ..... *B26D 5/20* (2013.01); *B65H 23/046* (2013.01); *B65H 23/1882* (2013.01); *B65H 2557/24* (2013.01); *B41F 13/60* (2013.01); *B65H 2801/21* (2013.01); *B65H 2513/10* (2013.01)

USPC ..... 101/485; 101/227

(58) Field of Classification Search

USPC ..... 101/485, 226, 227, 486; 226/30, 31, 27, 226/122; 83/367

See application file for complete search history.

(56) References Cited

U.S. PATENT DOCUMENTS

| | | | | |
|---|---|---|---|---|
| 2,249,820 | A | 7/1941 | Gulliksen et al. | |
| 3,608,799 | A * | 9/1971 | Edson | 226/31 |
| 4,361,260 | A * | 11/1982 | Hanlan | 226/30 |
| 4,882,764 | A | 11/1989 | Reynolds et al. | |
| 4,885,785 | A | 12/1989 | Reynolds et al. | |
| 4,955,265 | A * | 9/1990 | Nakagawa et al. | 83/74 |
| 5,458,062 | A * | 10/1995 | Goldberg et al. | 101/485 |

(Continued)

FOREIGN PATENT DOCUMENTS

| | | |
|---|---|---|
| CH | 400190 | 10/1965 |
| DE | G 85 01 065.0 U1 | 4/1985 |

(Continued)

OTHER PUBLICATIONS

Bradley, "Webatron 120," in *Graphische Woche*, 13/1967, p. 633.

*Primary Examiner* — Matthew G Marini
(74) *Attorney, Agent, or Firm* — Leydig, Voit & Mayer, Ltd.

(57) ABSTRACT

In order to control the cut register of a web (1) in a web-fed rotary press, a pulling device (Z3) which transports the web (1) is changed with regard to its circumferential speed.

11 Claims, 1 Drawing Sheet

(56) References Cited

U.S. PATENT DOCUMENTS

| | | | | | |
|---|---|---|---|---|---|
| 5,480,085 | A | * | 1/1996 | Smithe et al. | 226/44 |
| 5,568,767 | A | * | 10/1996 | Jackson | 101/226 |
| 5,802,974 | A | * | 9/1998 | McNeil | 101/226 |
| 5,937,756 | A | | 8/1999 | Kishine et al. | |
| 6,092,466 | A | * | 7/2000 | Koch et al. | 101/485 |
| 2001/0018872 | A1 | | 9/2001 | Tokiwa | |
| 2003/0136283 | A1 | * | 7/2003 | Tokiwa | 101/226 |
| 2005/0039622 | A1 | | 2/2005 | Brandenburg et al. | |

FOREIGN PATENT DOCUMENTS

| | | | | |
|---|---|---|---|---|
| DE | 36 02 894 | C2 | | 8/1987 |
| DE | 42 38 387 | A1 | | 6/1994 |
| EP | 0 914 44 | A2 | | 5/1999 |
| EP | 1044915 | A2 | * | 10/2000 |
| EP | 11 107 29 | A2 | | 6/2001 |
| GB | 2 272 402 | A | | 5/1994 |
| WO | WO 02/07975 | A1 | | 1/2002 |

* cited by examiner

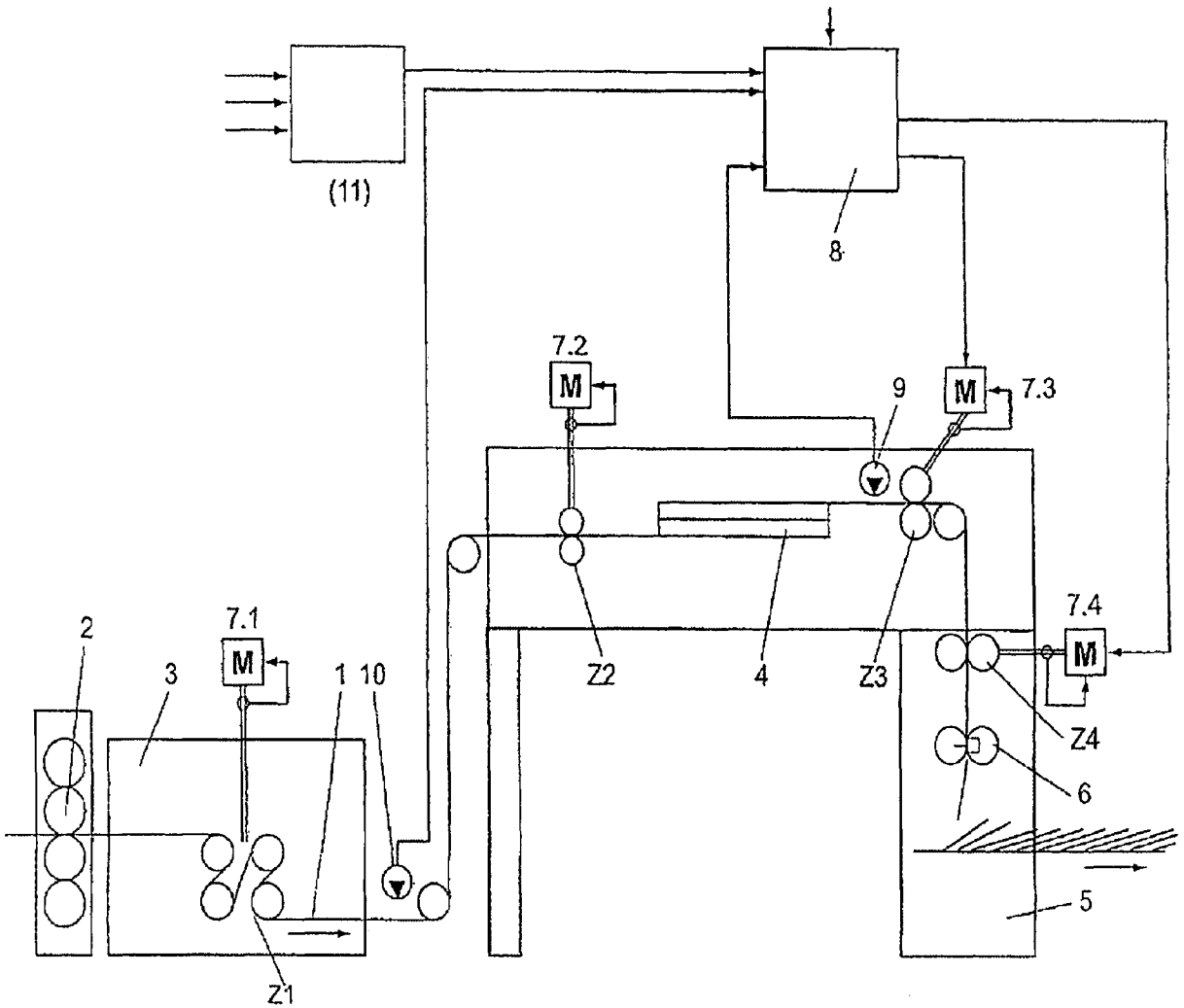
7.4
M
Z4
6
5
7.3
M
9
8
Z3
4
7.2
M
Z2
(11)
10
1
7.1
M
Z1
3
2

METHOD AND APPARATUS FOR CONTROLLING THE CUT REGISTER OF A WEB-FED ROTARY PRESS

FIELD OF THE INVENTION

The invention relates to a method and an apparatus for controlling the cut register of a web-fed rotary press.

BACKGROUND OF THE INVENTION

In web-fed rotary presses, it is known to use an actuating roll which can be displaced in linear guides as an actuating element for cut-register control, using which actuating roll the paper path length between two pulling units is changed and the register error is thus corrected. Register rolls of this type are shown, for example, in DE 85 01 065 U1. The adjustment is generally carried out by means of an electric stepping motor. Apparatuses of this type are associated with relatively great mechanical and electrical complexity.

SUMMARY OF THE INVENTION

It is an object of for controlling the cut register. Furthermore, an apparatus is to be provided which is distinguished by low mechanical and electrical complexity.

The object is achieved by the method and apparatus of the invention. The solution does not require any additional mechanical web-guiding element. For cut-register correction, non-printing pulling units which are already present are used, such as the cooling unit, pull rolls in the folder superstructure, the former roll or further pulling units which lie on the web path between the last printing unit and the knife cylinder. The linear register roll, in particular, with the stepping motor and associated actuation electronics is dispensed with as a result of the variable-speed individual drives on the pulling units.

As a consequence of the particular properties of the control system, the cut-register control is dynamically faster than in the conventional solution by means of a register roll, as a change in the lead of the relevant pulling unit replaces a path change.

The parameters which are incorporated into the cut-register control system are largely independent of the properties of the rotary press. Furthermore, the cut-register accuracy can be increased substantially by the new method.

In the method of the invention, the running time of the web image points with a constant web path is adjusted whereas, in the prior art, a change has been made to the web length at a constant web speed.

The cut register is corrected by the adjustment of the lead of a non-printing pulling unit between the last printing unit and the knife cylinder. This correcting variable influences the cut-register error, as seen in stationary operation, proportionally to the length of the free web between the engaging, non-printing pulling location and the pulling location lying ahead of it.

The register control system is of an order one lower than in the conventional control with an actuating roll, on account of the fact that it is not an angle or a path but a speed which has to be adjusted. As seen in control technology terms, there is a good approximation of an aperiodic PT2 path.

A PI controller can therefore be used as a register controller. A subordinated web tension control means can additionally be provided.

The actuation time of the closed register control circuit depends only on the sum of the small time constants of the register control system. The web time constant is either compensated for by the adjusting time of the PI register controller, or other optimization criteria of control technology are used. As the rotational-speed control circuit is dynamically very fast, the register control using the novel method is substantially faster than in the conventional solution with a register roll.

The invention is to be explained in greater detail in the following text using an exemplary embodiment shown in the drawing.

BRIEF DESCRIPTION OF THE DRAWING

The FIG. 1 shows an apparatus for controlling the cut register in a web-fed rotary press, the pulling unit Z3 being used as the actuating element by way of example.

DETAILED DESCRIPTION OF THE INVENTION

The FIG. 1 shows the path of a web 1 from a last printing unit 2 via a pulling unit Z1 in the form of a cooling unit 3, a pulling unit Z2 ahead of a turning unit 4, a pulling unit Z3 after the pulling unit 4, and a pulling unit Z4 ahead of a folding unit 5. In the folding unit 5, the web 1 is cross-cut by means of a cross-cutting device 6, for example by means of a pair of cutting rolls. Each pulling unit Z1 to Z4 is driven by a motor 7.1 to 7.4 with an associated motor control means.

The motor 7.3 of the pulling unit Z3 is connected to the output of a controller 8 to whose input a cut-register sensor 9 is connected. Moreover, a further 5 cut-register sensor 10 is connected to the controller 8. The cut-register sensor 10 is arranged on a web section which is situated at a further pulling unit arranged ahead of the pulling unit Z3 in the web running direction. It is thus also possible for the cut-register 10 which is situated ahead of the pulling unit Z2 to be arranged on the web section between the last printing unit 2 and the cooling unit 3. Furthermore, the controller 8 is connected to the motor 7.4 of the pulling unit Z4 which follows the pulling unit 23 in the web running direction, for the purpose of supplying its lead setpoint value.

The web 1 is printed in a printing press and, after leaving the last printing unit 2, is guided to the folding unit 5 on the path which is shown in simplified form in the FIGURE. In the process, it passes through the pulling unit Z1 which is configured as a cooling unit 3, the pulling unit Z2 ahead of the turning unit 4, the turning unit 4, the pulling unit Z3 after the turning unit 4, and the pulling unit Z4 ahead of the folding unit 5. The web 1 is cross-cut in the cross-cutting device 6, it being necessary to feed the web 1 with the matching cut register. The cut register is controlled by means of the controller 8, the pulling unit Z3 functioning as an actuating element. The actual state of the cut register is determined by means of the cut-register sensor 9 which senses cut-register marks which are printed on the web 1, and passed to the controller 8. The motor 7.3 is changed with regard to its circumferential speed, in accordance with the deviation from the setpoint value. Furthermore, the actual value of the cut register is determined by means of the cut-register sensor 10 at a web section which lies ahead of the pulling unit Z3, and a differentiating proportion is fed to the controller 8 in order to subject the latter to feedforward control. Furthermore, the actuating intervention of the controller 8 is used to supply the setpoint value for the lead to the pulling unit Z4. For the case where further pulling units are situated after the pulling unit 23 in the web running direction, the actuating intervention of the control circuit 8 can also be used for these, in order to supply setpoint values for the leads.

The controller 8 can also be subjected to feedforward control in such a way that the actual state of the cut register is determined without sensors by means of a mathematical model and a differentiating proportion is derived and used for the feedforward control of the controller 8. This variant is shown in the FIGURE using thin lines and with the number 11 in brackets. Measured values, for example the lead of the cooling unit 3, the web tension on the threading unit and optionally other and further measured values, are fed to the computing and storage unit 11, from which measured values the actual state of the cut-register error is calculated using the mathematical model.

Furthermore, the control algorithm of the controller 8 comprises a mathematical model in such a way that the forces of the web 1 which have a counteractive effect on the torque of the motor that corrects the cut register are compensated for to a very large extent.

The invention claimed is:

1. A method for controlling a cut register of a web-fed rotary press, the cut register representing placement of cuts on a web, the method comprising:

guiding a web leaving a last printing unit of the rotary press to a cross-cutting device via at least two pulling units with adjustable leads, there being no movable tensioning roller between the at least two pulling units, and wherein the pulling units are independently rotatable from one another and from the cross-cutting device: and changing a circumferential speed of at least one of the pulling units to adjust the cut register.

2. A method as in claim 1, wherein the step of changing includes: detecting a first actual value of the cut register using a first cut-register sensor; feeding the detected first actual value of the cut register to a controller; comparing, by the controller, the detected actual value of the cut register with a cut-register setpoint value representing a predetermined desired placement of a cut on the web; adjusting, by the controller, a motor of said at least one pulling unit to change the circumferential speed.

3. A method as in claim 2, further including: providing a second cut-register sensor positioned at a second pulling unit upstream of said at least one pulling unit; detecting a second actual value of the cut register using the second cut-register sensor; deriving a differentiating proportion from the first and second actual values of the cut register; and applying, by the controller, feedforward control based on the differentiating proportion.

4. A method as in claim 2, further including: determining an actual state of the cut register based on a mathematical model; deriving a differentiating proportion from the actual state of the cut register; and applying, by the controller, feedforward control based on the differentiating proportion.

5. A method as in claim 2, further including: supplying by the controller to a second pulling unit downstream of said at least one pulling unit a second setpoint value for controlling a lead of the second pulling unit.

6. A method as in claim 2, further including compensating by the controller a counteractive effect by forces of the web on a torque of the motor of said at least one pulling unit.

7. An apparatus for controlling a cut register of a web-fed rotary press having a web guided from a last printing unit to a cross cutting device via a plurality of pulling units, wherein the pulling units are independently rotatable from one another and from the cross-cutting device, there being no movable tensioning roller between the pulling units, and the cut register representing placement of cuts on the web, the apparatus comprising:

a controller connected to a motor of at least one of the pulling units; and a first cut-register sensor disposed to detect a first actual value of the cut register on the web and feed the detected first actual value to the controller, wherein the controller controls the motor to adjust a speed of said at least one pulling unit based on the first actual value of the cut register.

8. An apparatus as in claim 7, further including a second cut-register sensor connected to the controller and disposed at a second pulling unit upstream of said at least one pulling unit, the second cut-register sensor detecting a second actual value of the cut register and feeding the second actual value to the controller, the controller applying feedforward control based on the second actual value.

9. An apparatus as in claim 7, further including a computing unit connected to the controller, the computing unit calculating an actual state of the cut register based on a mathematical model, the controller receiving the calculated actual state from the computing unit and applying feedforward control based on the calculated actual state.

10. An apparatus as in claim 7, wherein the controller is further connected to a motor of a second pulling unit downstream of said at least one pulling unit and provides to the second pulling unit a setpoint value representing a predetermined desired placement of a cut on the web for controlling a lead of the second pulling unit.

11. An apparatus as in claim 7, wherein the controller controls said at least one pulling unit to compensate for a counteracting effect by forces of the web on a torque of the motor of said at least one pulling unit.

* * * * *